US008602001B2

(12) United States Patent
Kaiser et al.

(10) Patent No.: US 8,602,001 B2
(45) Date of Patent: Dec. 10, 2013

(54) TORQUE LIMITING ENGINE LUBRICATION PROTECTION SYSTEM

(75) Inventors: Jeffrey M. Kaiser, Highland, MI (US); Christopher E. Whitney, Commerce, MI (US); Timothy W. Athan, Ann Arbor, MI (US); Dennis A. Light, Monroe, MI (US); Timothy L. Gibbs, Bloomfield Hills, MI (US)

(73) Assignee: GM Global Technology Operations LLC

( * ) Notice: Subject to any disclaimer, the term of this patent is extended or adjusted under 35 U.S.C. 154(b) by 356 days.

(21) Appl. No.: 13/011,202

(22) Filed: Jan. 21, 2011

(65) Prior Publication Data

US 2012/0067327 A1 Mar. 22, 2012

Related U.S. Application Data

(60) Provisional application No. 61/383,904, filed on Sep. 17, 2010.

(51) Int. Cl.
*F02D 41/00* (2006.01)

(52) U.S. Cl.
USPC ..... 123/350; 123/686

(58) Field of Classification Search
USPC ..... 123/319, 320, 349, 350, 395, 396, 563, 123/686, 41.01, 41.05, 41.11, 41.12
See application file for complete search history.

(56) References Cited

U.S. PATENT DOCUMENTS

| | | | | |
|---|---|---|---|---|
| 5,479,898 | A * | 1/1996 | Cullen et al. | 123/350 |
| 6,259,986 | B1 * | 7/2001 | Kotwicki | 701/101 |
| 6,311,493 | B1 * | 11/2001 | Kurihara et al. | 60/600 |
| 6,401,026 | B2 * | 6/2002 | Robichaux et al. | 701/110 |
| 6,618,666 | B2 * | 9/2003 | Amano et al. | 701/113 |
| 6,889,653 | B2 * | 5/2005 | Kang et al. | 123/395 |
| 6,993,427 | B2 * | 1/2006 | Ueda | 701/111 |
| 7,054,738 | B1 * | 5/2006 | Stotsky | 701/115 |
| 7,698,049 | B2 * | 4/2010 | Whitney et al. | 701/103 |
| 2002/0107106 | A1 * | 8/2002 | Kato et al. | 477/110 |
| 2002/0129788 | A1 * | 9/2002 | O'Neil et al. | 123/350 |
| 2005/0090968 | A1 * | 4/2005 | Sato | 701/114 |
| 2007/0235005 | A1 * | 10/2007 | Lewis | 123/322 |
| 2009/0037073 | A1 * | 2/2009 | Jung et al. | 701/101 |
| 2010/0280738 | A1 * | 11/2010 | Whitney et al. | 701/102 |

* cited by examiner

*Primary Examiner* — John Kwon
*Assistant Examiner* — Johnny Hoang

(57) ABSTRACT

A lubrication torque limit module includes a temperature module that determines a temperature of an engine and generates an engine temperature signal. A limit module generates a torque limit signal based on the temperature signal and a speed of the engine. The torque limit signal identifies an indicated torque maximum limit. A torque arbitration module limits indicated torque of the engine based on the indicated torque maximum limit. The indicated torque of the engine is equal to an unmanaged brake torque of the engine plus an overall friction torque of the engine.

20 Claims, 6 Drawing Sheets

TORQUE LIMITING ENGINE LUBRICATION PROTECTION SYSTEM

CROSS-REFERENCE TO RELATED APPLICATIONS

This application claims the benefit of U.S. Provisional Application No. 61/383,904, filed on Sep. 17, 2010. The disclosure of the above application is incorporated herein by reference in its entirety.

FIELD

The present disclosure relates to engine lubrication systems and components.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines (ICEs) combust an air and fuel mixture within cylinders to drive pistons, which produces drive torque. Air flow into the ICE is regulated via a throttle. More specifically, the throttle adjusts throttle area, which adjusts air flow into the ICE. A fuel control system adjusts the rate that fuel is injected to provide a desired air/fuel mixture to the cylinders and/or to achieve a desired torque output. Increasing the amount of air and fuel provided to the cylinders increases the torque output of the ICE. A turbocharger may be used, for example, to increase air flow into the cylinders of the ICE.

Engine systems include components that are cooled and/or lubricated via respective fluids, such as oil, water, glycol-based coolants, etc. The components may include pistons, piston rod bearings, camshaft and crankshaft bearings, turbocharger compressor and turbine bearings, etc. During certain conditions, high engine loads may be requested when an inadequate supply and/or viscosity of a cooling/lubricating fluid is present. This can result in damage to engine components. For example, cooling/lubricating fluids supplied from an ICE to a turbocharger may drain out of the turbocharger when the ICE is shutdown. The cooling/lubricating fluids are pumped to the turbocharger when the ICE is restarted. Time for the fluids to reach components of the turbocharger can depend on sizes of fluid feed lines and/or orifices. During a cold start of the ICE, high turbocharger loads may be introduced prior to an adequate supply of the cooling/lubricating fluids reaching bearings of the turbocharger. This can cause damage to turbocharger components.

As another example, during a cold start of an engine if there is an inadequate amount of oil supplied to cylinders of an engine, piston scuff can result. Piston scuff refers to rubbing of a piston against a cylinder wall due to inadequate clearances between the piston and the cylinder wall. Clearances between a piston and a cylinder wall can vary depending on temperatures and materials of the piston and the cylinder wall. As an example, a piston may be formed of aluminum and a cylinder wall may be formed of iron, which heats and expands at different rates then aluminum.

As yet another example, during high temperature conditions, viscosity of cooling/lubricating fluids can decrease (i.e. thin-out). This reduces cooling and lubricating affects on respective engine components, which can result in damage to the engine components.

SUMMARY

A lubrication torque limit module is provided and includes a temperature module that determines a temperature of an engine and generates an engine temperature signal. A limit module generates a torque limit signal based on the temperature signal and a speed of the engine. The torque limit signal identifies an indicated torque maximum limit. A torque arbitration module limits indicated torque of the engine based on the indicated torque maximum limit. The indicated torque of the engine is equal to an unmanaged brake torque of the engine plus an overall friction torque of the engine. Indicated torque may refer to a torque available from combustion events in cylinders of the engine without subtracting off losses, such as friction losses, pumping losses, and losses associated with accessories.

In other features, a method is provided that includes determining a temperature of an engine and generating an engine temperature signal. A first torque limit signal is generated based on the temperature signal and a speed of the engine. The first torque limit signal identifies an indicated torque maximum limit. Indicated torque of the engine is limited based on the indicated torque maximum limit. The indicated torque of the engine is equal to an unmanaged brake torque of the engine plus an overall friction torque of the engine.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
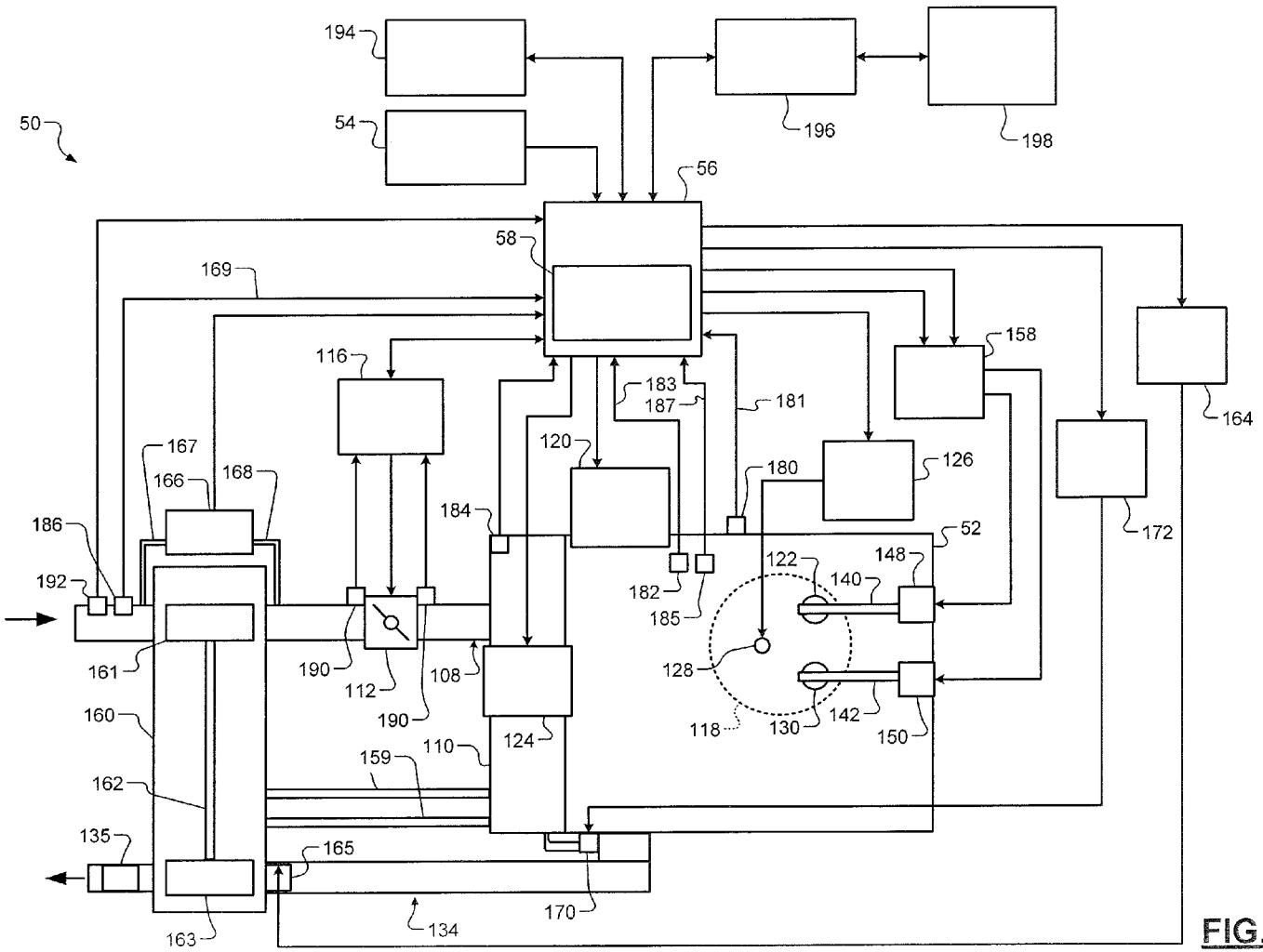
FIG. 1 is a functional block diagram of an engine system incorporating a lubrication torque limiting module in accordance with the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

In FIG. 1, an exemplary engine system 50 is shown. The engine system 50 includes an engine 52 that combusts an air/fuel mixture to produce drive torque for a vehicle based on driver inputs from a driver input module 54. The engine system 50 is controlled via an engine control module (ECM) 56, which includes a lubrication torque limit module 58. The lubrication torque limit module 58 limits indicated torque (referred to as lubrication torque limiting) of the engine 52 during certain conditions and based on certain engine parameters.

Indicated torque $TQ_I$ may be equal to unmanaged brake torque $TQ_{UB}$ plus overall friction torque $TQ_F$, as shown by equation 1.

$$TQ_I = TQ_B + TQ_F \quad (1)$$

Unmanaged brake torque $TQ_{UB}$ may refer to when spark and fuel are adjusted and provided for a received amount of air to generate a maximum output torque. The maximum output torque is provided based on the amount of air received by the engine 52. The overall friction torque $TQ_F$ refers to a sum of the friction torques of the engine 52. The overall friction torque $TQ_F$ may include internal component friction torques of the engine 52 and/or friction torques (or loads) exerted on the engine 52 by accessories. Example accessories are an alternator, an electric motor, an air conditioning compressor, etc.

Figure 2:
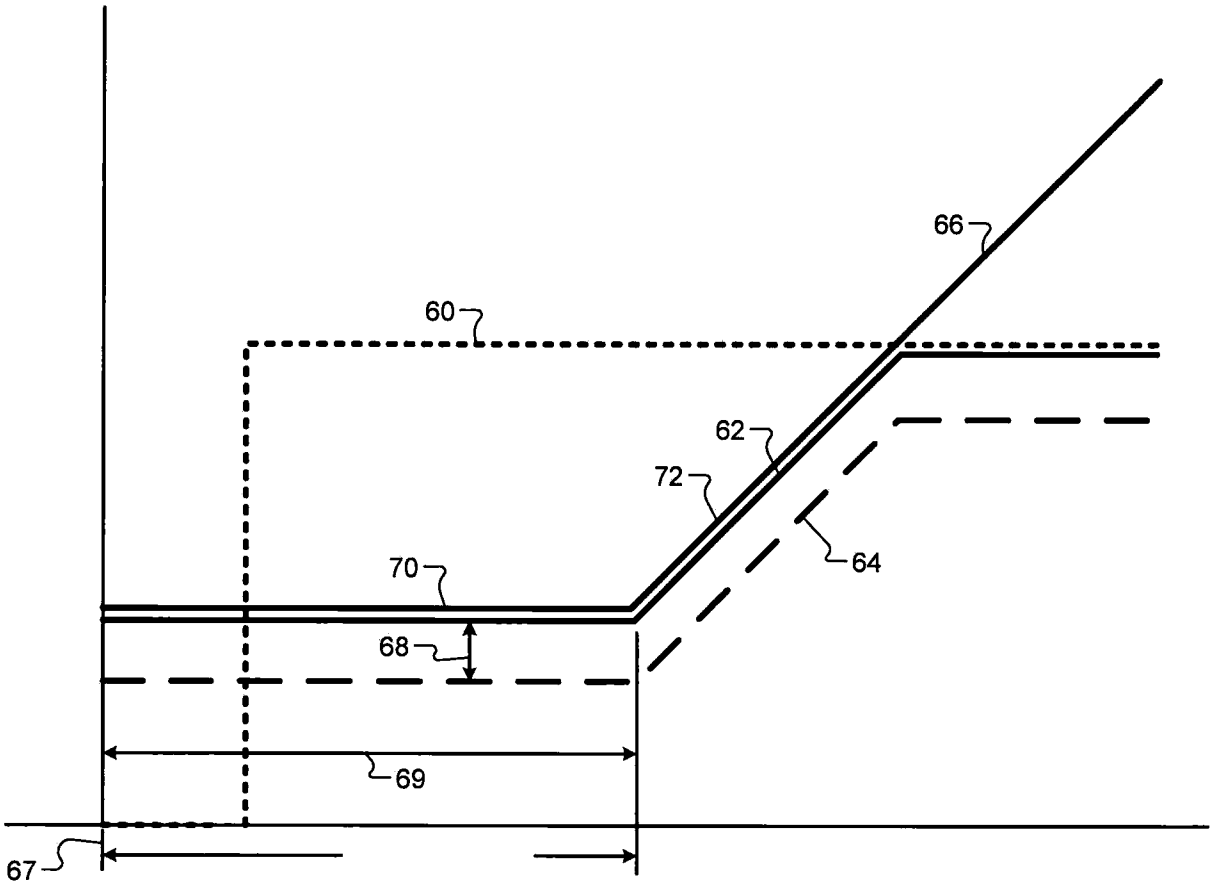
FIG. 2 is a torque limit plot in accordance with the present disclosure.

Referring now also to FIG. 2, a torque limit plot is shown. The torque limit plot includes a requested torque signal 60, an indicated torque signal 62, an unmanaged brake torque signal 64, and a lubrication torque limiting signal 66. The signals 60, 62, 64, 66 are plotted from an engine start time 67. The requested torque signal 60 may be a sum of requested output torques of the engine 52. The requested torque signal 60 may include predicted and immediate torque requests, as described below. The requested torque signal 60 may increase from 0, for example, when the engine 52 is started. The engine 52 may be started when fuel and spark are enabled.

The indicated torque signal 62 and the unmanaged brake torque signal 64 indicate estimates of indicated torque and unmanaged brake torque provided due to torque limiting. Difference between the indicated torque signal 62 and the unmanaged brake torque signal 64 is the overall friction torque, designated by line 68.

In the example shown, the lubrication torque limiting signal 66 may limit indicated torque for a predetermined period, such as during a cold start. An example limiting period 69 is shown and begins when the engine is started, as shown by the requested torque signal 60 at time 67. This is shown by a first portion (and associated period) 70 of the lubrication torque limiting signal 66. The predetermined period may be a stored fixed value and/or may be determined based on engine OFF time (or soak time) and engine temperature, as described further below. Subsequent to the predetermined period, the lubrication torque limiting signal 66 may be increased, as shown by a second portion (and associated period) 72. The lubrication torque limiting signal 66 may be gradually increased/decreased, ramped, stepped and/or adjusted using some other techniques when transitioning from a torque limiting mode to a non-torque limiting mode.

The indicated torque signal 62 may follow (or be approximately equal to) the lubrication torque limiting signal 66 when the lubrication torque limiting signal 66 is less than or equal to the requested torque signal 60. The indicated torque signal 62 may follow (or be approximately equal to) the requested torque signal 60 when the lubrication torque limiting signal 66 is greater than the requested torque signal 60.

The lubrication torque limit module 58 may limit indicated torque when the engine is cold (i.e. during a cold start) or hot (i.e. when viscosity of cooling/lubricating fluids decreases. The lubrication torque limit module 58 may limit indicated torque based on engine speed, engine temperature, and other engine parameters described below.

In operation, air is drawn into the engine 52 through an intake system 108. For example only, the intake system 108 may include an intake manifold 110 and a throttle valve 112. The ECM 58 controls a throttle actuator module 116, which regulates opening of the throttle valve 112 to control the amount of air drawn into the intake manifold 110. Air from the intake manifold 110 is drawn into cylinders of the engine 52. While the engine 52 may include multiple cylinders, for illustration purposes a single representative cylinder 118 is shown. The ECM 58 may instruct a cylinder actuator module 120 to selectively deactivate some of the cylinders, which may improve fuel economy under certain engine operating conditions.

Air from the intake manifold 110 is drawn into the cylinder 118 through an intake valve 122. The ECM 58 controls a fuel actuator module 124, which regulates fuel injection to achieve a desired air/fuel ratio. Fuel may be injected into the intake manifold 110 or directly into the cylinder 118.

The engine 52 may be a compression-ignition engine, in which case compression in the cylinder 118 ignites the air/fuel mixture. Alternatively, the engine 52 may be a spark-ignition engine, in which case a spark actuator module 126 energizes a spark plug 128 in the cylinder 118 based on a signal from the ECM 58, which ignites the air/fuel mixture. Combustion of the air/fuel mixture drives a piston in the cylinder 118, thereby driving a crankshaft. During an exhaust stroke, the piston guides byproducts of the combustion through an exhaust valve 130. The byproducts of combustion are exhausted from the vehicle via an exhaust system 134 with one or more catalysts 135.

The intake valve 122 may be controlled by an intake camshaft 140, while the exhaust valve 130 may be controlled by an exhaust camshaft 142. Timing of the intake and exhaust valves 122, 130 may be varied using an intake cam phaser 148 and an exhaust cam phaser 150. A phaser actuator module 158 may control the intake cam phaser 148 and the exhaust cam phaser 150 based on signals from the ECM 58.

The engine system 50 may include a boost device that provides pressurized air to the intake manifold 110. For example, FIG. 1 shows a turbocharger 160 including a compressor 161, a shaft 162 and a turbine 163. The turbine 163 receives exhaust gas from the engine 52. The turbine 163 rotates the shaft 162, which in turn rotates an impeller of the compressor 161 to compress ambient air. The compressed ambient air is provided to the cylinder 118. The turbocharger 160 may receive engine coolant and/or oil via supply and return lines 159. The turbocharger 160 may have a hydrodynamic bearing design (i.e. has an oil film viscosity or thickness minimum threshold (e.g., approximately 10 microns) above which the turbocharger 160 can support loads between rotating parts). A wastegate 165 may allow exhaust to bypass the turbine 163, thereby reducing the boost (the amount of intake air compression) of the turbocharger 160. The ECM 58 may control the turbocharger 160 via a boost actuator module 164.

One or more pressure sensors (one is shown) 166 may be used to detect a pressure differential and/or pressure ratio across the compressor 161. The pressure sensors 166 may be connected to tap lines 167, 168. The pressure sensors 166 may generate or be used to generate a pressure ratio signal RATIO 169. The pressure ratio signal RATIO 169 indicates a pressure ratio of the inlet pressure of the compressor 161 relative to the outlet pressure of the compressor 161, or vice versa. The first tap line may be used to detect pressure of air entering the compressor 161. The second tap line may be used to detect pressure of air exiting the compressor 161.

Although a signal delta pressure sensor may be used to generate the pressure ratio signal RATIO 169, in one implementation two pressure sensors are used. A first one of the pressure sensors 166 is connected to tap line 167 and determines a first. The first one of the sensors 166 may be, for example, a turbocharger inlet absolute pressure (TCIAP) sensor. A second one of the pressure sensors is connected to the tap line 168 and detects a second pressure. The second one of the sensors 166 may be, for example, a throttle inlet absolute pressure (TIAP) sensor. The pressure ratio signal RATIO 169 may be generated based on a difference between the first pressure and the second pressure.

The engine system 50 may include an exhaust gas recirculation (EGR) valve 170, which selectively redirects exhaust gas back to the intake manifold 110. The EGR valve 170 may be located downstream from the intake manifold 110 as shown or may be located upstream of the turbocharger 160 near an intake air temperature (IAT) sensor 192. The EGR valve 170 may be controlled by an EGR actuator module 172.

The engine system 50 may measure the speed of the crankshaft in revolutions per minute (RPM) using an RPM sensor 180. The RPM sensor 180 may generate an RPM signal 181. The temperature of the engine coolant may be measured using an engine coolant temperature (ECT) sensor 182 to generate an ECT signal 183. The temperature of the engine oil may be measured using an engine oil temperature (EOT) sensor 185, or modeled, to generate an EOT signal 187. The engine oil temperature may be modeled based on, for example, a vehicle speed, an engine speed, a coolant temperature, an air temperature, etc. The ECT sensor 182 and the EOT sensor 185 may be located within the engine 52 or at other locations where the coolant and oil are circulated, such as at a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located upstream of the turbo 160. The turbo 160 may include a bypass valve and/or bypass path that allows air to bypass the compressor 161. The bypass valve and/or bypass path may be used to reduce pressure upstream of the throttle valve 112 when the throttle valve 112 closes quickly and the compressor 161 is spinning at a speed greater than a predetermined speed.

The throttle actuator module 116 may monitor the position of the throttle valve 112 using one or more throttle position sensors (TPS) 190. The ambient temperature of air being drawn into the engine 52 may be measured using the IAT sensor 192. The ECM 58 may use signals from the sensors to make control decisions for the engine system 50.

The ECM 58 may communicate with a transmission control module 194 to coordinate shifting gears in a transmission (not shown). For example, the ECM 58 may reduce engine torque during a gear shift. The ECM 58 may communicate with a hybrid control module 196 to coordinate operation of the engine 52 and an electric motor 198.

The electric motor 198 may also function as a generator, and may be used to produce electrical energy for use by vehicle electrical systems and/or for storage in a battery. In various implementations, various functions of the ECM 58, the transmission control module 194, and the hybrid control module 196 may be integrated into one or more modules.

Each system that varies an engine parameter may be referred to as an actuator that receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 126 may be referred to as an actuator, while the corresponding actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these actuators, the actuator values may correspond to number of activated cylinders, fueling rate, intake and exhaust cam phaser angles, boost pressure, and EGR valve opening area, respectively. The ECM 58 may control actuator values in order to cause the engine 52 to generate a desired engine output torque.

Figure 3:
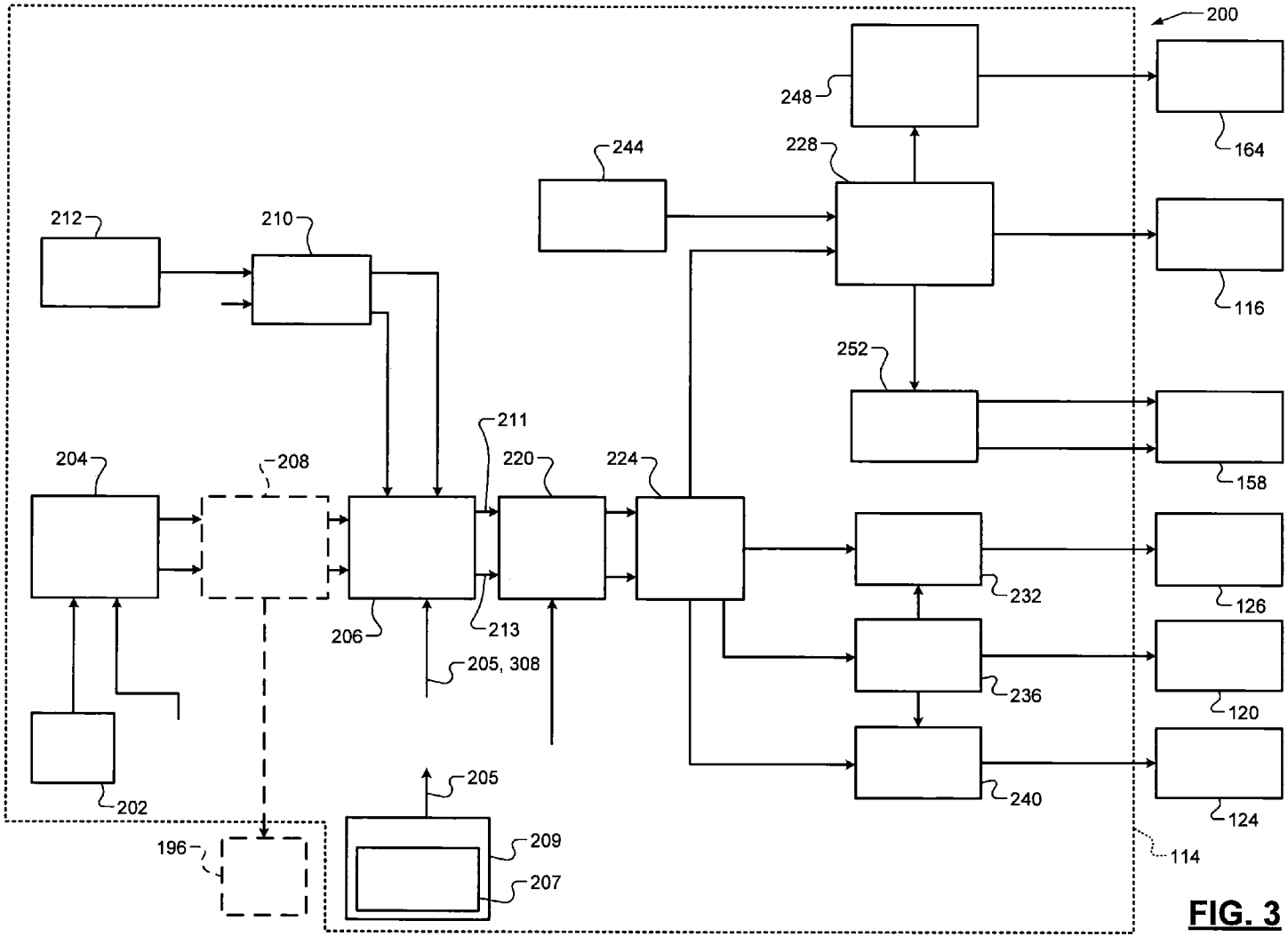
FIG. 3 is a functional block diagram of a control system incorporating a maximum torque module in accordance with the present disclosure.

Referring now also to FIG. 3, a control system 200 is shown. An example implementation of the ECM 58 includes a driver torque module 202. The driver torque module 202 may determine a driver torque request based on a driver input from the driver input module 54. The driver input may be based on a position of an accelerator pedal. The driver input may also be based on cruise control, which varies vehicle speed to maintain a predetermined following distance.

An axle torque arbitration module 204 arbitrates between the driver torque request from the driver torque module 202 and other axle torque requests. Axle torque (torque at the wheels) may be produced by various sources including an engine and/or an electric motor. Torque requests may include absolute torque requests as well as relative torque requests and ramp requests. For example only, ramp requests may include a request to ramp torque down to a minimum engine OFF torque or to ramp torque up from the minimum engine OFF torque. Relative torque requests may include temporary or persistent torque reductions or increases.

Axle torque requests may include a torque reduction requested by a traction control system when positive wheel slip is detected. Positive wheel slip occurs when axle torque overcomes friction between the wheels and the road surface, and the wheels begin to slip against the road surface. Axle torque requests may also include a torque increase request to counteract negative wheel slip, where a tire of the vehicle slips in the other direction with respect to the road surface because the axle torque is negative.

Axle torque requests may also include brake management requests and vehicle over-speed torque requests. Brake management requests may reduce axle torque to ensure that the axle torque does not exceed the ability of the brakes to hold the vehicle when the vehicle is stopped. Vehicle over-speed torque requests may reduce the axle torque to prevent the vehicle from exceeding a predetermined speed. Axle torque requests may also be generated by vehicle stability control systems.

The axle torque arbitration module 204 outputs a predicted torque request and an immediate torque request based on the results of arbitrating between the received torque requests. As described below, the predicted and immediate torque requests from the axle torque arbitration module 204 may selectively be adjusted by other modules of the ECM 58 before being used to control actuators of the engine system 50.

In general terms, the immediate torque request is the amount of currently desired axle torque, while the predicted torque request is the amount of axle torque that is attainable on short notice. The ECM 58 therefore controls the engine system 50 to produce an axle torque equal to the immediate torque request. However, different combinations of actuator values may result in the same axle torque. The ECM 58 may therefore adjust the actuator values to allow a faster transition to the predicted torque request, while still maintaining the axle torque at the immediate torque request.

In various implementations, the predicted torque request may be based on the driver torque request. The immediate torque request may be less than the predicted torque request, such as when the driver torque request is causing wheel slip on an icy surface. In such a case, a traction control system (not shown) may request a reduction via the immediate torque request, and the ECM 58 reduces the torque produced by the engine system 50 to the immediate torque request. However, the ECM 58 controls the engine system 50 so that the engine system 50 can quickly resume producing the predicted torque request once the wheel slip stops.

In general terms, the difference between the immediate torque request and the higher predicted torque request can be referred to as a torque reserve. The torque reserve may represent the amount of additional torque that the engine system 50 can begin to produce with minimal delay. Fast engine actuators are used to increase or decrease current axle torque. As described in more detail below, fast engine actuators are defined in contrast with slow engine actuators.

In various implementations, fast engine actuators are capable of varying axle torque within a range, where the range is established by the slow engine actuators. In such implementations, the upper limit of the range is the predicted torque request, while the lower limit of the range is limited by the torque capacity of the fast actuators. For example only, fast actuators may only be able to reduce axle torque by a first amount, where the first amount is a measure of the torque capacity of the fast actuators. The first amount may vary based on engine operating conditions set by the slow engine actuators. When the immediate torque request is within the range, fast engine actuators can be set to cause the axle torque to be equal to the immediate torque request. When the ECM 58 requests the predicted torque request to be output, the fast engine actuators can be controlled to vary the axle torque to the top of the range, which is the predicted torque request.

In general terms, fast engine actuators can more quickly change the axle torque when compared to slow engine actuators. Slow actuators may respond more slowly to changes in their respective actuator values than fast actuators do. For example, a slow actuator may include mechanical components that require time to move from one position to another in response to a change in actuator value. A slow actuator may also be characterized by the amount of time it takes for the axle torque to begin to change once the slow actuator begins to implement the changed actuator value. Generally, this amount of time will be longer for slow actuators than for fast actuators. In addition, even after beginning to change, the axle torque may take longer to fully respond to a change in a slow actuator.

For example only, the ECM 58 may set actuator values for slow actuators to values that would enable the engine system 50 to produce the predicted torque request if the fast actuators were set to appropriate values. Meanwhile, the ECM 58 may set actuator values for fast actuators to values that, given the slow actuator values, cause the engine system 50 to produce the immediate torque request instead of the predicted torque request.

The fast actuator values therefore cause the engine system 50 to produce the immediate torque request. When the ECM 58 decides to transition the axle torque from the immediate torque request to the predicted torque request, the ECM 58 changes the actuator values for one or more fast actuators to values that correspond to the predicted torque request. Because the slow actuator values have already been set based on the predicted torque request, the engine system 50 is able to produce the predicted torque request after only the delay imposed by the fast actuators. In other words, the longer delay that would otherwise result from changing axle torque using slow actuators is avoided.

For example only, when the predicted torque request is equal to the driver torque request, a torque reserve may be created when the immediate torque request is less than the drive torque request due to a temporary torque reduction request. Alternatively, a torque reserve may be created by increasing the predicted torque request above the driver torque request while maintaining the immediate torque request at the driver torque request. The resulting torque reserve can absorb sudden increases in required axle torque. For example only, sudden loads from an air conditioner or a power steering pump may be counterbalanced by increasing the immediate torque request. If the increase in immediate torque request is less than the torque reserve, the increase can be quickly produced by using fast actuators. The predicted torque request may then also be increased to re-establish the previous torque reserve.

Another example use of a torque reserve is to reduce fluctuations in slow actuator values. Because of their relatively slow speed, varying slow actuator values may produce control instability. In addition, slow actuators may include mechanical parts, which may draw more power and/or wear more quickly when moved frequently. Creating a sufficient torque reserve allows changes in desired torque to be made by varying fast actuators via the immediate torque request while maintaining the values of the slow actuators. For example, to maintain a given idle speed, the immediate torque request may vary within a range. If the predicted torque request is set to a level above this range, variations in the immediate torque request that maintain the idle speed can be made using fast actuators without the need to adjust slow actuators.

For example only, in a spark-ignition engine, spark timing may be a fast actuator value, while throttle opening area may be a slow actuator value. Spark-ignition engines may combust fuels including, for example, gasoline and ethanol, by applying a spark. By contrast, in a compression-ignition engine, fuel flow may be a fast actuator value, while throttle opening area may be used as an actuator value for engine characteristics other than torque. Compression-ignition engines may combust fuels including, for example, diesel, by compressing the fuels.

When the engine 52 is a spark-ignition engine, the spark actuator module 126 may be a fast actuator and the throttle actuator module 116 may be a slow actuator. After receiving a new actuator value, the spark actuator module 126 may be able to change spark timing for the following firing event. When the spark timing (also called spark advance) for a firing event is set to a calibrated value, maximum torque is produced in the combustion stroke immediately following the firing event. However, a spark advance deviating from the calibrated value may reduce the amount of torque produced in the combustion stroke. Therefore, the spark actuator module 126 may be able to vary engine output torque as soon as the next firing event occurs by varying spark advance. For example only, a table of spark advances corresponding to different engine operating conditions may be determined during a calibration phase of vehicle design, and the calibrated value is selected from the table based on current engine operating conditions.

By contrast, changes in throttle opening area take longer to affect engine output torque. The throttle actuator module 116 changes the throttle opening area by adjusting the angle of the blade of the throttle valve 112. Therefore, once a new actuator value is received, there is a mechanical delay as the throttle valve 112 moves from its previous position to a new position based on the new actuator value. In addition, air flow changes based on the throttle valve opening are subject to air transport delays in the intake manifold 110. Further, increased air flow in the intake manifold 110 is not realized as an increase in engine output torque until the cylinder 118 receives additional air in the next intake stroke, compresses the additional air, and commences the combustion stroke.

Using these actuators as an example, a torque reserve can be created by setting the throttle opening area to a value that would allow the engine 52 to produce a predicted torque request. Meanwhile, the spark timing can be set based on an immediate torque request that is less than the predicted torque request. Although the throttle opening area generates enough air flow for the engine 52 to produce the predicted torque request, the spark timing is retarded (which reduces torque) based on the immediate torque request. The engine output torque will therefore be equal to the immediate torque request.

When additional torque is needed, such as when the air conditioning compressor is started, or when traction control determines wheel slip has ended, the spark timing can be set based on the predicted torque request. By the following firing event, the spark actuator module 126 may return the spark advance to a calibrated value, which allows the engine 52 to produce the full engine output torque achievable with the air flow already present. The engine output torque may therefore be quickly increased to the predicted torque request without experiencing delays from changing the throttle opening area.

When the engine 52 is a compression-ignition engine, the fuel actuator module 124 may be a fast actuator and the throttle actuator module 116 and the boost actuator module 164 may be emissions actuators. In this manner, the fuel mass may be set based on the immediate torque request, and the throttle opening area and boost may be set based on the predicted torque request. The throttle opening area may generate more air flow than necessary to satisfy the predicted torque request. In turn, the air flow generated may be more than required for complete combustion of the injected fuel such that the air/fuel ratio is usually lean and changes in air flow do not affect the engine torque output. The engine output torque will therefore be equal to the immediate torque request and may be increased or decreased by adjusting the fuel flow.

The throttle actuator module 116, the boost actuator module 164, and the EGR actuator module 172 may be controlled based on the predicted torque request to control emissions and to minimize turbo lag. The throttle actuator module 116 may create a vacuum to draw exhaust gases through the EGR valve 170 and into the intake manifold 110.

The axle torque arbitration module 204 may output the predicted torque request and the immediate torque request to a propulsion torque arbitration module 206. In various implementations, the axle torque arbitration module 204 may output the predicted and immediate torque requests to a hybrid optimization module 208. The hybrid optimization module 208 determines how much torque should be produced by the engine 52 and how much torque should be produced by the electric motor 198. The hybrid optimization module 208 then outputs modified predicted and immediate torque requests to the propulsion torque arbitration module 206. In various implementations, the hybrid optimization module 208 may be implemented in the hybrid control module 196.

The predicted and immediate torque requests received by the propulsion torque arbitration module 206 are converted from an axle torque domain (torque at the wheels) into a propulsion torque domain (torque at the crankshaft). This conversion may occur before, after, as part of, or in place of the hybrid optimization module 208.

The propulsion torque arbitration module 206 arbitrates between propulsion torque requests, including the converted predicted and immediate torque requests and an arbitrated limit output request ALO 205. The arbitrated limit output request ALO 205 indicates a requested maximum indicated torque (or indicated torque limit) for the engine 52 to generate. The arbitrated limit output request ALO 205 may be generated by a torque limit determination module 207 of an engine capacities and capabilities module 209, which are further described with respect to FIG. 4 below. The torque limit determination module 207 may change the indicated torque maximum limit to a brake, crankshaft, and/or flywheel limit before being used by the arbitration system 206.

The propulsion torque arbitration module 206 generates an arbitrated predicted torque request 211 and an arbitrated immediate torque request 213. The arbitrated torques may be generated by selecting a winning request from among received requests. Alternatively or additionally, the arbitrated torques may be generated by modifying one of the received requests based on another one or more of the received requests.

Other propulsion torque requests 308 may include torque reductions for engine over-speed protection, torque increases for stall prevention, and torque reductions requested by the transmission control module 194 to accommodate gear shifts.

Propulsion torque requests may also result from clutch fuel cutoff, which reduces the engine output torque when the driver depresses the clutch pedal in a manual transmission vehicle to prevent a flare (rapid rise) in engine speed.

Propulsion torque requests may also include an engine shutoff request, which may be initiated when a critical fault is detected. For example only, critical faults may include detection of vehicle theft, a stuck starter motor, electronic throttle control problems, and unexpected torque increases. In various implementations, when an engine shutoff request is present, arbitration selects the engine shutoff request as the winning request. When the engine shutoff request is present, the propulsion torque arbitration module 206 may output zero as the arbitrated torques.

In various implementations, an engine shutoff request may simply shut down the engine 52 separately from the arbitration process. The propulsion torque arbitration module 206 may still receive the engine shutoff request so that, for example, appropriate data can be fed back to other torque requestors. For example, all other torque requestors may be informed that they have lost arbitration.

An RPM control module 210 may also output predicted and immediate torque requests to the propulsion torque arbitration module 206. The torque requests from the RPM control module 210 may prevail in arbitration when the ECM 58 is in an RPM mode. RPM mode may be selected when the driver removes his/her foot from the accelerator pedal, such as when the vehicle is idling or coasting down from a higher speed. Alternatively or additionally, RPM mode may be selected when the predicted torque request from the axle torque arbitration module 204 is less than a predetermined torque value.

The RPM control module 210 receives a desired RPM from an RPM trajectory module 212, and controls the predicted and immediate torque requests to reduce the difference between the desired RPM and the current RPM. For example only, the RPM trajectory module 212 may output a linearly decreasing desired RPM for vehicle coast down until an idle RPM is reached. The RPM trajectory module 212 may then continue outputting the idle RPM as the desired RPM.

A reserves/loads module 220 receives the arbitrated predicted and immediate torque requests from the propulsion torque arbitration module 206. The reserves/loads module 220 may adjust the arbitrated predicted and immediate torque requests to create a torque reserve and/or to compensate for one or more loads. The reserves/loads module 220 then outputs the adjusted predicted and immediate torque requests to an actuation module 224.

For example only, a catalyst light-OFF process or a cold start emissions reduction process may require retarded spark advance. The reserves/loads module 220 may therefore increase the adjusted predicted torque request above the adjusted immediate torque request to create retarded spark for the cold start emissions reduction process. In another example, the air/fuel ratio of the engine and/or the mass air flow may be directly varied, such as by diagnostic intrusive equivalence ratio testing and/or new engine purging. Before beginning these processes, a torque reserve may be created or increased to quickly offset decreases in engine output torque that result from leaning the air/fuel mixture during these processes.

The reserves/loads module 220 may also create or increase a torque reserve in anticipation of a future load, such as power steering pump operation or engagement of an air conditioning (A/C) compressor clutch. The reserve for engagement of the A/C compressor clutch may be created when the driver first requests air conditioning. The reserves/loads module 220 may increase the adjusted predicted torque request while leaving the adjusted immediate torque request unchanged to produce the torque reserve. Then, when the A/C compressor clutch engages, the reserves/loads module 220 may increase the immediate torque request by the estimated load of the A/C compressor clutch.

The actuation module 224 receives the adjusted predicted and immediate torque requests from the reserves/loads module 220. The actuation module 224 determines how the adjusted predicted and immediate torque requests will be achieved. The actuation module 224 may be engine type specific. For example, the actuation module 224 may be implemented differently or use different control schemes for spark-ignition engines versus compression-ignition engines.

In various implementations, the actuation module 224 may define a boundary between modules that are common across all engine types and modules that are engine type specific. For example, engine types may include spark-ignition and compression-ignition. Modules prior to the actuation module 224, such as the propulsion torque arbitration module 206, may be common across engine types, while the actuation module 224 and subsequent modules may be engine type specific.

For example, in a spark-ignition engine, the actuation module 224 may vary the opening of the throttle valve 112 as a slow actuator that allows for a wide range of torque control. The actuation module 224 may disable cylinders using the cylinder actuator module 120, which also provides for a wide range of torque control, but may also be slow and may involve drivability and emissions concerns. The actuation module 224 may use spark timing as a fast actuator. However, spark timing may not provide as much range of torque control. In addition, the amount of torque control possible with changes in spark timing (referred to as spark reserve capacity) may vary as air flow changes.

In various implementations, the actuation module 224 may generate an air torque request based on the adjusted predicted torque request. The air torque request may be equal to the adjusted predicted torque request, setting air flow so that the adjusted predicted torque request can be achieved by changes to other actuators.

An air control module 228 may determine desired actuator values based on the air torque request. For example, the air control module 228 may control desired manifold absolute pressure (MAP), desired throttle area, and/or desired air per cylinder (APC). Desired MAP may be used to determine desired boost, and desired APC may be used to determine desired cam phaser positions. In various implementations, the air control module 228 may also determine an amount of opening of the EGR valve 170.

The actuation module 224 may also generate a spark torque request, a cylinder shut-OFF torque request, and a fuel torque request. The spark torque request may be used by a spark control module 232 to determine how much to retard the spark timing (which reduces engine output torque) from a calibrated spark advance.

The cylinder shut-OFF torque request may be used by a cylinder control module 236 to determine how many cylinders to deactivate. The cylinder control module 236 may instruct the cylinder actuator module 120 to deactivate one or more cylinders of the engine 52. In various implementations, a predefined group of cylinders may be deactivated jointly.

The cylinder control module 236 may also instruct a fuel control module 240 to stop providing fuel for deactivated cylinders and may instruct the spark control module 232 to stop providing spark for deactivated cylinders. In various implementations, the spark control module 232 stops providing spark for a cylinder only once any fuel/air mixture already present in the cylinder has been combusted.

In various implementations, the cylinder actuator module 120 may include a hydraulic system that selectively decouples intake and/or exhaust valves from the corresponding camshafts for one or more cylinders in order to deactivate those cylinders. For example only, valves for half of the cylinders are either hydraulically coupled or decoupled as a group by the cylinder actuator module 120. In various implementations, cylinders may be deactivated simply by halting provision of fuel to those cylinders, without stopping the opening and closing of the intake and exhaust valves. In such implementations, the cylinder actuator module 120 may be omitted.

The fuel control module 240 may vary the amount of fuel provided to each cylinder based on the fuel torque request from the actuation module 224. During normal operation of a spark-ignition engine, the fuel control module 240 may operate in an air lead mode in which the fuel control module 240 attempts to maintain a stoichiometric air/fuel ratio by controlling fuel flow based on air flow. The fuel control module 240 may determine a fuel mass that will yield stoichiometric combustion when combined with the current amount of air per cylinder. The fuel control module 240 may instruct the fuel actuator module 124 via the fueling rate to inject this fuel mass for each activated cylinder.

In compression-ignition systems, the fuel control module 240 may operate in a fuel lead mode in which the fuel control module 240 determines a fuel mass for each cylinder that satisfies the fuel torque request while minimizing emissions, noise, and fuel consumption. In the fuel lead mode, air flow is controlled based on fuel flow and may be controlled to yield a lean air/fuel ratio. In addition, the air/fuel ratio may be maintained above a predetermined level, which may prevent black smoke production in dynamic engine operating conditions.

A mode setting may determine how the actuation module 224 treats the adjusted immediate torque request. The mode setting may be provided to the actuation module 224, such as by the propulsion torque arbitration module 206, and may select modes including an inactive mode, a pleasible mode, a maximum range mode, and an auto actuation mode.

In the inactive mode, the actuation module 224 may ignore the adjusted immediate torque request and set engine output torque based on the adjusted predicted torque request. The actuation module 224 may therefore set the spark torque request, the cylinder shut-OFF torque request, and the fuel torque request to the adjusted predicted torque request, which maximizes engine output torque for the current engine air flow conditions. Alternatively, the actuation module 224 may set these requests to predetermined (such as out-of-range high) values to disable torque reductions from retarding spark, deactivating cylinders, or reducing the fuel/air ratio.

In the pleasible mode, the actuation module 224 outputs the adjusted predicted torque request as the air torque request and attempts to achieve the adjusted immediate torque request by adjusting only spark advance. The actuation module 224 therefore outputs the adjusted immediate torque request as the spark torque request. The spark control module 232 will retard the spark as much as possible to attempt to achieve the spark torque request. If the desired torque reduction is greater than the spark reserve capacity (the amount of torque reduction achievable by spark retard), the torque reduction may not be achieved. The engine output torque will then be greater than the adjusted immediate torque request.

In the maximum range mode, the actuation module 224 may output the adjusted predicted torque request as the air torque request and the adjusted immediate torque request as the spark torque request. In addition, the actuation module 224 may decrease the cylinder shut-OFF torque request (thereby deactivating cylinders) when reducing spark advance alone is unable to achieve the adjusted immediate torque request.

In the auto actuation mode, the actuation module 224 may decrease the air torque request based on the adjusted immediate torque request. In various implementations, the air torque request may be reduced only so far as is necessary to allow the spark control module 232 to achieve the adjusted immediate torque request by adjusting spark advance. Therefore, in auto actuation mode, the adjusted immediate torque request is achieved while adjusting the air torque request as little as possible. In other words, the use of relatively slowly-responding throttle valve opening is minimized by reducing the quickly-responding spark advance as much as possible. This allows the engine 52 to return to producing the adjusted predicted torque request as quickly as possible.

A torque estimation module 244 may estimate torque output of the engine 52. This estimated torque may be used by the air control module 228 to perform closed-loop control of engine air flow parameters, such as throttle area, MAP, and phaser positions. For example, a torque relationship such as that provided by equation 2 may be used, where torque (T) is a function of air per cylinder (APC), spark advance (S), intake cam phaser position (I), exhaust cam phaser position (E), air/fuel ratio (AF), oil temperature (OT), and number of activated cylinders (#).

$$T=f(\mathrm{APC},S,I,E,\mathrm{AF},\mathrm{OT},\#) \tag{2}$$

Additional variables may also be accounted for, such as the degree of opening of an exhaust gas recirculation (EGR) valve.

This relationship may be modeled by an equation and/or may be stored as a lookup table. The torque estimation module 244 may determine APC based on measured MAF and current RPM, thereby allowing closed loop air control based on actual air flow. The intake and exhaust cam phaser positions used may be based on actual positions, as the phasers may be traveling toward desired positions.

The actual spark advance may be used to estimate the actual engine output torque. When a calibrated spark advance value is used to estimate torque, the estimated torque may be called an estimated air torque, or simply air torque. The air torque is an estimate of how much torque the engine could generate at the current air flow if spark retard was removed (i.e., spark timing was set to the calibrated spark advance value) and all cylinders were fueled.

The air control module 228 may output a desired area signal to the throttle actuator module 116. The throttle actuator module 116 then regulates the throttle valve 112 to produce the desired throttle area. The air control module 228 may generate the desired area signal based on an inverse torque model and the air torque request. The air control module 228 may use the estimated air torque and/or the MAF signal in order to perform closed loop control. For example, the desired area signal may be controlled to minimize a difference between the estimated air torque and the air torque request.

The air control module 228 may output a desired manifold absolute pressure (MAP) signal to a boost scheduling module 248. The boost scheduling module 248 uses the desired MAP signal to control the boost actuator module 164. The boost actuator module 164 then controls one or more turbochargers (e.g., the turbocharger 160) and/or superchargers.

The air control module 228 may also output a desired air per cylinder (APC) signal to a phaser scheduling module 252.

Based on the desired APC signal and the RPM signal, the phaser scheduling module 252 may control positions of the intake and/or exhaust cam phasers 148 and 150 using the phaser actuator module 158.

Referring back to the spark control module 232, calibrated spark advance values may vary based on various engine operating conditions. For example only, a torque relationship may be inverted to solve for desired spark advance. For a given torque request ($T_{des}$), the desired spark advance ($S_{des}$) may be determined based on equation 3.

$$S_{des}=T^{-1}(T_{des},\mathrm{APC},I,E,\mathrm{AF},\mathrm{OT},\#) \quad (3)$$

This relationship may be embodied as an equation and/or as a lookup table. The air/fuel ratio (AF) may be the actual air/fuel ratio, as reported by the fuel control module 240.

When the spark advance is set to the calibrated spark advance, the resulting torque may be as close to minimum spark advance for best torque (MBT) as possible. MBT refers to the maximum engine output torque that is generated for a given air flow as spark advance is increased, while using fuel having an octane rating greater than a predetermined threshold and using stoichiometric fueling. The spark advance at which this maximum torque occurs is referred to as MBT spark. The calibrated spark advance may differ slightly from MBT spark because of, for example, fuel quality (such as when lower octane fuel is used) and environmental factors. The torque at the calibrated spark advance may therefore be less than MBT.

Figure 4:
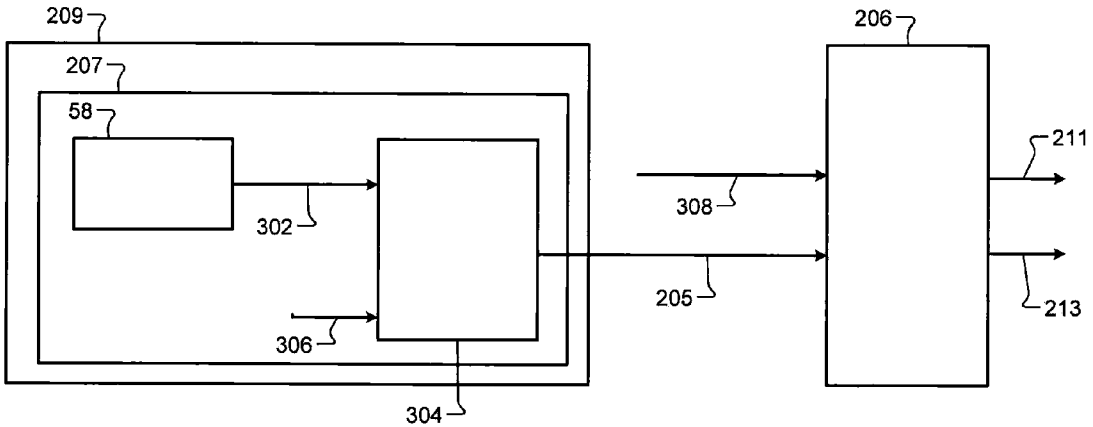
FIG. 4 is a functional block diagram of an arbitration system in accordance with the present disclosure.

Referring now also to FIG. 4, an arbitration system 300 is shown. The arbitration system 300 includes the engine capacities and capabilities (ECP) module 209 and the propulsion torque arbitration module 206. The ECP module 205 determines various torque values and torque limit values, such as an engine torque output at wide open throttle, an engine torque output at closed throttle, a lubrication torque limit, etc. The ECP module 205 includes the maximum torque module 207, which includes the lubrication torque limit module 58. The lubrication torque limit module 58 generates a torque limit output signal $\mathrm{LubTQLim}_2$ 302. The torque limit output signal $\mathrm{LubTQLim}_2$ 302 is generated to limit indicated torque of the engine 52. Limiting indicated torque of the engine 52 limits speed of and load on systems and components of the engine 52, such as speeds and loads of the turbocharger 160. Limiting indicated torque limits mass air flow through the turbocharger 160.

The torque limit determination module 207 further includes a maximum torque arbitration module 304 that generates the arbitrated torque limit output signal ALO 205. The arbitrated torque limit output signal ALO 205 is generated based on the torque limit output signal $\mathrm{LubTQLim}_2$ 302 and other maximum torque limits 306. The maximum torque arbitration module 304 arbitrates the torque limit output signal $\mathrm{LubTQLim}_2$ 302 against the other maximum torque limits 306 to generate the arbitrated torque limit output signal ALO 205. The torque limit output signal $\mathrm{LubTQLim}_2$ 302 is a brake and/or crankshaft torque limit that is generated based on the indicated torque limit. A conversion from the indicated torque limit to the torque limit output signal $\mathrm{LubTQLim}_2$ 302 is performed prior to the torque limit output signal $\mathrm{LubTQLim}_2$ 302 being received by the arbitration of maximum limits 304. This conversion may be performed, for example, by the lubrication torque limit module 58 and/or by the torque limit determination module 207.

The propulsion torque arbitration module 206 arbitrates the arbitrated torque limit output signal ALO 205 against other propulsion torque requests 308 to generate the arbitrated predicted torque request 211 and the arbitrated immediate torque request 213. Air flow, fuel, spark, phaser control, etc. may be adjusted based on the arbitrated predicted torque request 211 and the arbitrated immediate torque request 213 to adjust the indicated torque. The propulsion torque arbitration module 206 may generate the torque requests 211, 213 based on the indicated torque and/or the brake torque, although the propulsion torque arbitration module 206 as shown generates the torque requests 211, 213 based on the brake torque.

Figure 5:
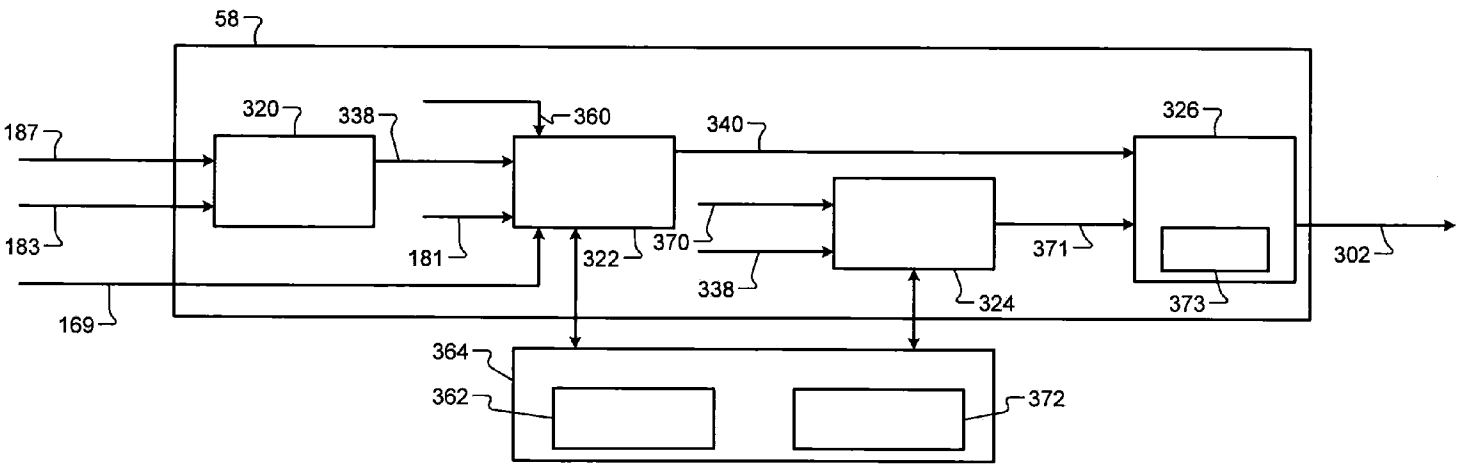
FIG. 5 is a functional block diagram of the lubrication torque limit module of FIG. 1.
Figure 6:
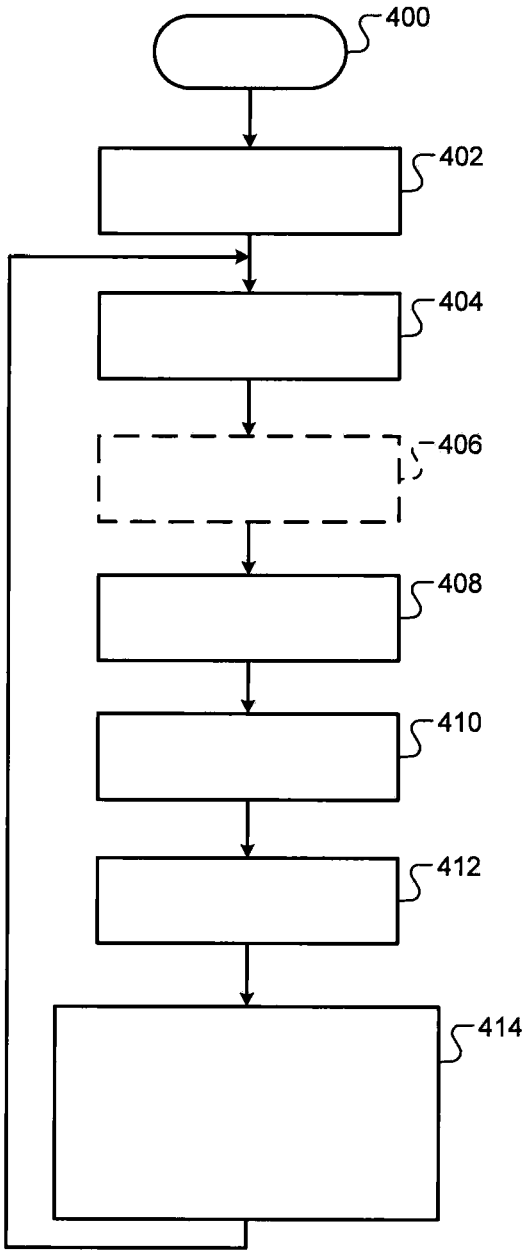
FIG. 6 is a flow diagram illustrating a method of limiting indicated torque of an engine in accordance with the present disclosure.

Referring now also to FIGS. 5 and 6, the lubrication torque limit module 58 and a method of limiting indicated torque of the engine 52 are shown. The lubrication torque module 58 includes a temperature selecting module 320, a lubrication maximum limit module 322, a time limit module 324 and a transition adjustment module 326. Although shown as distinct modules, the time limit module 324 and the transition adjustment module 326 may be incorporated in the lubrication maximum limit module 322. Although the following tasks are primarily described with respect to the implementations of FIGS. 1-5, the tasks may be easily modified to apply to other implementations of the present disclosure. The tasks may be iteratively performed. The method may begin at 400.

At 402, temperature of the engine 52 is detected. Temperature of the engine 52 indirectly indicates viscosity of cooling/lubricating fluids of the engine. The viscosity of the cooling/lubricating fluids is related to the amount of time for the fluids to reach components of the engine system 50 (e.g., to a thrust bearing of the turbocharger 160). The viscosity of the cooling/lubricating fluids is also related to the amount of time for fluid pressures to build to desired levels at engine system components (e.g. to build at a turbocharger bearing).

The temperature selecting module 320 may select at least one of the ECT signal 183 and the EOT signal 187 and/or a composite signal calculated based on the ECT signal 183 and the EOT signal 187. The selection may be based on the fluids supplied to and received from the turbocharger 160 and/or other component of the engine 52. As an example, indicated torque of the engine 52 may be limited based on temperature that best represents the temperature of the lubricating fluid supplied to the turbocharger 160. If engine coolant is supplied to the turbocharger 160 then the ECT signal 183 is selected. If engine oil is supplied to the turbocharger 160 then the EOT signal 187 is selected. This selection provides a better estimate of turbocharger temperature. The temperature selecting module 320 generates an engine temperature output signal TEMP 338 based on the selected ones of the ECT signal 183 and the EOT signal 187.

At 404, speed of the engine 52 is determined and the engine speed signal RPM 181 is generated. At 406, the pressure ratio RATIO 169 may be detected. At 408, engine OFF time is determined and the engine OFF time signal OFFTIME 370 is generated. The engine OFF time indicates how much fluid has drained back to, for example, a sump or holding reservoir during engine shutdown. The amount of oil drained back is related to the amount of time for components of the engine 52 to receive cooling/lubricating fluids when the engine 52 is restarted. The lubrication torque limit module 58, a dedicated OFF time module (not shown), the ECM 56, or some other module may estimate the engine OFF time.

In one implementation and at 410, the lubrication maximum limit module 322 generates a lubrication maximum torque limit signal $\mathrm{LubTQLim}_1$ 340 based on the engine temperature output signal TEMP 338 and the engine speed signal RPM 181. The lubrication maximum torque limit signal $\mathrm{LubTQLim}_1$ 340 indicates an indicated torque limit (level), which is used to limit indicated torque of the engine 52. In other implementations, the lubrication maximum limit module 322 may generate the lubrication maximum torque limit signal $LubTQLim_1$ 340 based on the pressure ratio RATIO 169 and/or a catalyst light-OFF signal LIGHTOFF 360 in addition to being based on the engine temperature output signal TEMP 338 and the engine speed signal RPM 181. The catalyst light-OFF signal LIGHTOFF 360 may indicate when a catalyst light-OFF (or regeneration) event is being performed.

The lubrication maximum limit module 322 may generate the lubrication maximum torque limit signal $LubTQLim_1$ 340 based on an algorithm, functions, and/or tables, such as a selected maximum limit table from multiple maximum limit tables 362 stored in memory 364. The selected maximum limit tables may provide maximum torque limit values based on independent variables, such as a current engine temperature and a current engine speed indicated by the engine temperature output signal TEMP 338 and the engine speed signal RPM 181.

To account for catalyst light-OFF, the maximum torque limit values stored in the maximum limit tables 362 for engine speeds less than or equal to a predetermined engine speed may be set to a predetermined disable value. This accounts for catalyst light-OFF without reliance on the catalyst light-OFF signal LIGHTOFF 360. The predetermined engine speed may be, for example, 1400 RPM. Risks of damage due to inadequate cooling and/or lubricating of components decreases as engine speed decreases. Engine and turbocharger loads at engine speeds equal to or less than 1400 RPM have negligible associated risks of component damage due to lack of adequate cooling/lubrication.

As such, lubrication torque limiting may be disabled to avoid interference with catalyst light-OFF. The predetermined disable value may be set to a high predetermined value to disable lubrication torque limiting. The high predetermined value may be greater than or equal to an estimated maximum indicated torque output of the engine 52 for engine speeds experienced during catalyst light-OFF.

The maximum limit tables 362 may also provide maximum torque limit values based on the pressure ratio RATIO 169. The pressure ratio RATIO 169 indicates the speed and/or loads on the turbocharger 160. Lubrication torque limiting may be disabled when the actual pressure ratio RATIO 169 is less than a predetermined pressure ratio.

At 412, the time limit module 324 determines a lubrication torque limiting period LIMPER 371 based on the engine temperature output signal TEMP 338 and an OFF time (or soak time) signal OFFTIME 370 of the engine 52. The lubrication torque limiting period LIMPER 371 may also be generated based on certain conditions, such as time for a lubricating/cooling fluid to be received by an engine system device (e.g., a turbocharger) and/or time for pressure of a lubricating/cooling fluid of the engine system device to be greater than a predetermined pressure. The conditions may be directly determined and/or indirectly estimated. The lubrication torque limiting period LIMPER 371 may be determined using an algorithm, functions and/or tables. The time limit module 324 may determine and/or limit the lubrication torque limiting period LIMPER 371 based on a selected one of the period limiting tables 372 stored in the memory 364. The period limiting tables 372 may indicate a limiting period based on the engine temperature output signal TEMP 338 and the soak time signal OFFTIME 370. The time limit module 324 may include a timer 373, which may be initialized to the lubrication time limit period LIMPER 371 when lubrication torque limiting is enabled or when the engine starts spinning. The timer 373 may timeout when the lubrication time limit period LIMPER 371 has lapsed.

The period limiting tables 372 may be based on certain relationships between the engine temperature output signal TEMP 338 and the soak time signal OFFTIME 370. For example, the limiting periods of the tables may increase as the soak time signal OFFTIME 370 increases. As an example, the limiting periods may increase from 0 to a predetermined limiting period (e.g., 10 seconds (s)) based on the soak time signal OFFTIME 370. The limiting period LIMPER 371 may be close to or equal to 0 when the soak time signal OFFTIME 370 is equal to 0. The limiting period LIMPER 371 may be equal to the predetermined time when the soak time signal OFFTIME 370 is greater than equal to a predetermined soak period (e.g. 36 s). More than, for example, 90% of a cooling/lubricating fluid may drain back to a sump or reservoir and away from a lubricated component (e.g., bearing) within the predetermined soak period.

Limiting indicated torque based on the soak time signal OFFTIME 370 prevents highly loading engine system components of a hybrid system. For example, the engine 52 may be activated and deactivated based on loads requested. By detecting the soak time signal OFFTIME 370, the lubrication torque limit module 58 accounts for engine OFF time variations by limiting indicated torque based on the soak time signal OFFTIME 370. Since the engine 52 may be disabled for a period of time, the soak time is tracked to estimate an amount of drain back of the cooling/lubricating fluid.

As the engine temperature output signal TEMP 338 increases, the limiting periods may decrease until a predetermined threshold is met. For engine temperatures greater than the predetermined threshold, the limiting periods may increase with increasing engine temperature. For example, if viscosity (or thickness) of the engine coolant and/or oil decreases to a point when damage to engine components can occur, lubrication torque limiting (or indicated torque limiting) is enabled. The lubrication torque limiting may be enabled when the engine temperature output signal TEMP 338 exceeds the predetermined threshold.

At 414, the transition adjustment module 326 generates the torque limit output signal $LubTQLim_2$ 302 based on the lubrication maximum torque limit signal $LubTQLim_1$ 340 and the limiting period LIMPER 371. The torque limit output signal $LubTQLim_2$ 302 is generated to limit indicated torque of the engine 52. The torque limit output signal $LubTQLim_2$ 302 and/or brake torque is provided to the maximum torque arbitration module 304 of FIG. 4.

The transition adjustment module 326 adjusts the lubrication maximum torque limit signal $LubTQLim_1$ 340 when transitioning to and from a lubrication torque limiting mode (or to and from an indicated torque limited mode). The transition adjustment module 326 may, for example, ramp in torque limiting (i.e. decrease torque limit values) when enabling the lubrication torque limiting mode. As another example, the transition adjustment module 326 may ramp out torque limiting (i.e. increase torque limit values) when disabling the lubrication torque limiting mode. Ramp up and ramp down rates and/or durations may be the same or different. Other techniques may be used when transitioning to and from the lubrication torque limiting mode. The transitions may be smooth transitions or may be stepped.

Disablement of lubrication torque limiting may be based on: a predetermined delay; the limiting period LIMPER 371, and/or a maximum limiting period stored in one of the period limiting tables 372. Lubrication torque limiting may be disabled when the limiting period LIMPER 371 times out. This may be determined by the timer 373. The timer 373 may be reset subsequent to disabling lubrication torque limiting and/or when lubrication torque limiting is reenabled.

The lubrication torque limiting period LIMPER 371 may be adjusted and/or the timer 373 may prevent disabling of lubrication torque limiting (timing out or resetting of the timer 373 based on the runtime of the engine 52. For example, an engine may be cycled ON and OFF in a short period via a key ignition system and/or during engine activation/deactivation of a hybrid system. Adjustment of the limiting period LIMPER 371 and/or preventing disablement of torque limiting prevents increasing load on an engine when there is an inadequate supply of cooling/lubricating fluids supplied to components of an engine system.

Although FIG. 6 illustrates the lubrication torque limit module 58 returning to task 404 subsequent to performing task 414, the lubrication torque limiting module may return to any one of tasks 402-412 during and/or subsequent to performing task 414. The lubrication torque limit module 58 may return to task 404 instead of task 402 when lubrication torque limiting during a lubrication load limiting event is checked once. The lubrication torque limiting event may be based on an initial detected engine temperature. In other implementations, the lubrication torque limit module 58 may continuously return to task 402 during a lubrication torque limiting event to obtain an updated engine temperature. The method may alternatively end subsequent to task 414.

Figure 7:
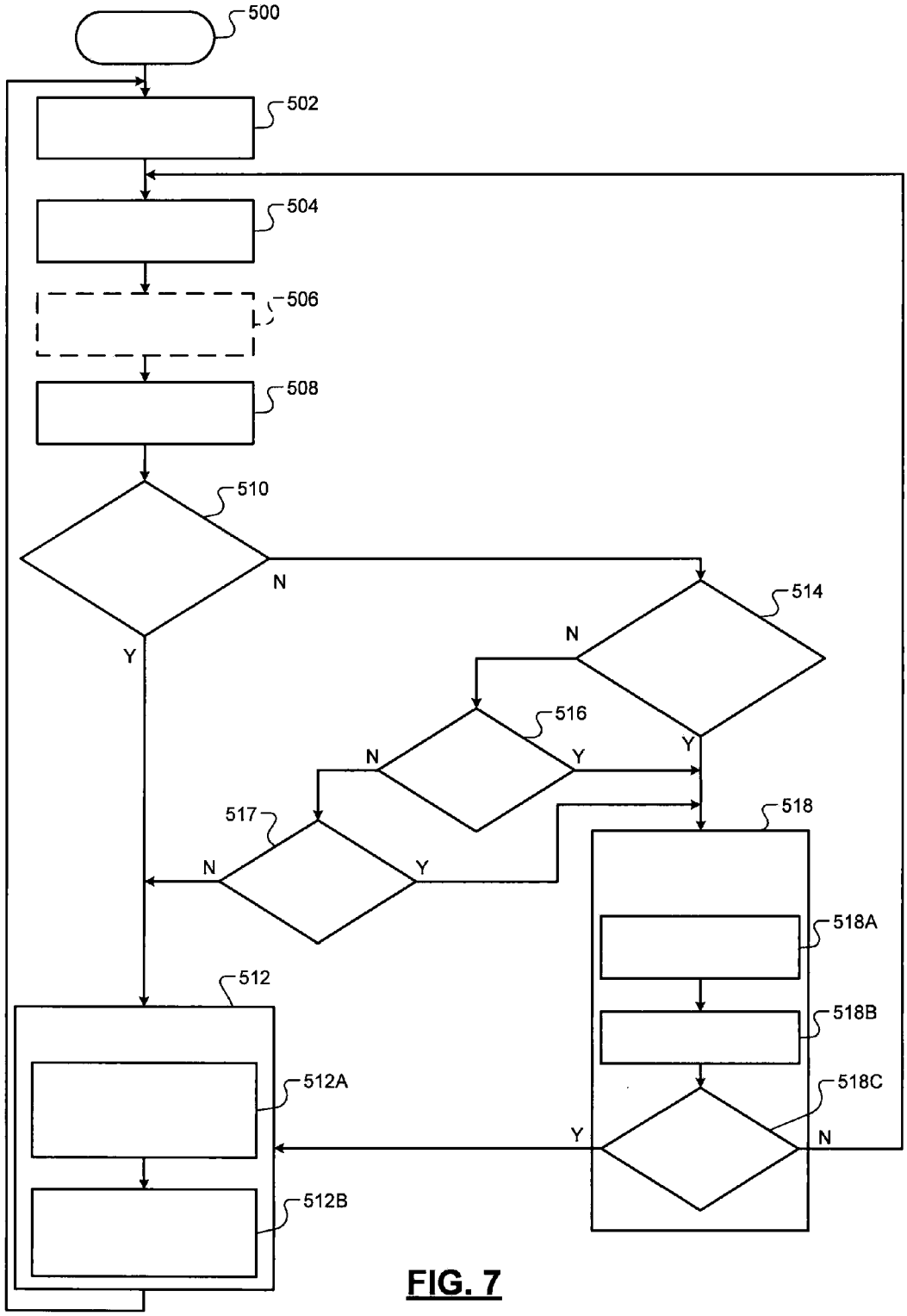
FIG. 7 is a flow diagram illustrating another method of limiting indicated torque of an engine in accordance with the present disclosure.

In FIG. 7, a flow diagram illustrating another method of operating an engine system is shown. The method of FIG. 7 may be combined with or used in replacement of the method of FIG. 6. Although the following tasks are primarily described with respect to the implementations of FIGS. 1-5, the tasks may be easily modified to apply to other implementations of the present disclosure. The tasks may be iteratively performed. The method may begin at 500.

At 502, the temperature selecting module 320 determines temperature of the engine 52 and generates the engine temperature output signal TEMP 338, as described above for task 402. At 504, speed of the engine 52 is determined, as described above for task 404. At 506, pressure ratio of the compressor 161 may be determined, as described above for task 406. At 508, engine OFF time is determined, as described above for task 408.

At 510, the lubrication maximum limit module 322 and/or the lubrication torque limit module 58 may determine if catalyst light-OFF is enabled and/or if speed of the engine 52 is less than or equal to a predetermined engine speed for catalyst light-OFF. This determination may be based on the catalyst light-OFF signal and/or based on the engine speed signal RPM 181. If catalyst light-OFF is enabled and/or the engine speed is less than the predetermined engine speed then task 512 may be performed, otherwise task 514 may be performed.

At 512, the lubrication torque limit module 58 disables lubrication torque limiting if enabled. The lubrication torque limiting period LIMPER 371 may be adjusted and/or the timer 373 may prevent disabling of lubrication torque limiting (timing out or resetting of the timer 373) based on the runtime of the engine 52. At 512A, the lubrication maximum limit module 322 may generate the lubrication maximum torque limit signal $LubTQLim_1$ 340 to disable lubrication torque limiting. This may include increasing value of the lubrication maximum torque limit signal $LubTQLim_1$ 340 HIGH or greater than maximum indicated torque levels for a current operating condition and/or mode (such as that generated during catalyst light-OFF). At 512B, the transition adjustment module 326 may transition out of the lubrication torque limiting mode if enabled based on the lubrication maximum torque limit signal $LubTQLim_1$ 340.

At 514, the lubrication torque limit module 58 and/or the lubrication maximum limit module 322 may determine whether the temperature of the engine 52 is less than a first predetermined temperature $T_{Low}$ or greater than a second predetermined temperature $T_{High}$. Temperatures less than the first predetermined temperature $T_{Low}$ may be associated with, for example, a cold start. Temperatures greater than the second predetermined temperature $T_{High}$ may be associated with thinning of cooling/lubricating fluids.

Piston scuff can occur when there is high engine loading at temperatures less than the first predetermined temperature $T_{Low}$. The first predetermined temperature $T_{Low}$ may be different than the predetermined temperature used to detect a catalyst light-OFF condition at task 510. The engine 52 and/or the turbocharger 160 may experience high loads and component damage when engine temperatures exceed the second predetermined temperature $T_{High}$. Task 514 allows lubrication torque limiting to be enabled for both low and high engine temperatures. Task 516 may be performed when the temperature of the engine 52 is less than the first predetermined temperature $T_{Low}$ or greater than the second predetermined temperature $T_{High}$. Task 518 may be performed when the temperature of the engine 52 is greater than or equal to the first predetermined temperature $T_{Low}$ or less than or equal to the second predetermined temperature $T_{High}$.

At 516, the lubrication torque limit module 58 and/or the lubrication maximum limit module 322 may determine whether the engine speed RPM is greater than a predetermined engine speed. Engine speeds greater than the predetermined engine speed may be associated with high loading, high temperatures, low fluid viscosity levels, etc. If the engine speed RPM is greater than the predetermined temperature, task 518 may be performed, otherwise task 512 may be performed.

At 517, the lubrication torque limit module 58 and/or the lubrication maximum limit module 322 may determine whether the pressure ratio RATIO 169 is greater than a predetermined pressure ratio. Pressure ratios greater than the predetermined pressure ration may be associated with high compressor loads, high compressor temperatures, low viscosity levels of compressor fluids, etc. If the pressure ratio RATIO 169 is greater than the predetermined pressure ratio, task 518 may be performed, otherwise task 512 may be performed.

At 518, the lubrication torque limit module 58 may enable lubrication torque limiting if currently disabled. At 518A, the lubrication maximum limit module 322 generates the lubrication maximum torque limit signal $LubTQLim_1$ 340 to enable lubrication torque limiting. The lubrication maximum torque limit signal $LubTQLim_1$ 340 may be generated as in task 410 above. At 518B, a limiting period may be determined as in task 412 above.

At 518C, the transition adjustment module 326 may determine if the limiting period has timed out. Task 512 may be performed when the limiting period has timed out, otherwise task 504 may be performed. The timer 373 may be reset subsequent to performing task 512 and/or when lubrication torque limiting is reenabled.

Although FIG. 7 illustrates the lubrication torque limit module 58 returning to task 504 subsequent to performing task 518, the lubrication torque limiting module may return to any one of tasks 502-510, 514 and 516 during and/or subsequent to performing task 518. The method may alternatively end subsequent to task 518.

The above-described tasks of FIGS. 6 and 7 are meant to be illustrative examples; the tasks may be performed sequentially, synchronously, simultaneously, continuously, during overlapping time periods or in a different order depending upon the application.

The implementations of the above disclosure prevent engine system hardware damage. This includes preventing: turbocharger bearing damage from high turbocharger loads while coolant and/or oil pressures of the turbocharger are low following an engine start; main and rod bearing damage due to high engine loads while oil pressure is low following an engine start; main and rod bearing damage due to low oil film thicknesses at high oil temperatures and high engine loads; and piston scuff due to high engine loads and low engine temperatures.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A lubrication torque limit module comprising:

a temperature module that determines a temperature of an engine and generates an engine temperature signal;

a first limit module that generates a first torque limit signal based on the engine temperature signal and a speed of the engine, wherein the first torque limit signal identifies an indicated torque maximum limit;

a second limit module that determines a limit period based on an amount of time the engine is OFF; and a torque arbitration module that limits indicated torque of the engine for the limit period and based on the indicated torque maximum limit, wherein the indicated torque of the engine is equal to an unmanaged brake torque of the engine plus an overall friction torque of the engine.

2. The lubrication torque limit module of claim 1, wherein the temperature module is configured to:

receive an oil temperature signal indicating a temperature of an engine oil of the engine;

receive a coolant temperature signal indicating a temperature of an engine coolant of the engine;

select at least one of the oil temperature signal and the coolant temperature signal based on at least one of (i) whether an engine system device receives the engine oil, and (ii) whether the engine system device receives the engine coolant; and generate the engine temperature signal based on at least one of the oil temperature signal and the coolant temperature signal.

3. The lubrication torque limit module of claim 2, wherein the engine system device is a turbocharger.

4. The lubrication torque limit module of claim 1, wherein the first limit module generates the first torque limit signal to disable lubrication torque limiting during a catalyst light off event.

5. The lubrication torque limit module of claim 1, wherein the first limit module generates the first torque limit signal based on at least one of (i) a compressor pressure ratio, and (ii) a first table relating indicated torque to temperature of the engine and speed of the engine.

6. The lubrication torque limit module of claim 1 wherein:

the second limit module generates a limit period signal based on the amount of time the engine is OFF and the engine temperature signal;

the limit period signal indicates the limit period;

the torque arbitration module limits the indicated torque of the engine based on the limit period signal;

the first limit module generates the first torque limit signal based on a first table relating indicated torque to temperature of the engine and speed of the engine; and the second limit module generates the limit period signal based on a second table relating the limit period to the amount of time the engine is OFF and the engine temperature signal.

7. The lubrication torque limit module of claim 1, wherein the engine limits at least one of a load on a turbocharger and a speed of the turbocharger based on the first torque limit signal.

8. The lubrication torque limit module of claim 1, wherein the first limit module:

generates the first torque limit signal to disable lubrication torque limiting of the indicate torque of the engine when the engine temperature signal is greater than a first predetermined temperature and less than a second predetermined temperature, the second predetermined temperature is greater than the first predetermined temperature; and generates the first torque limit signal to enable lubrication torque limiting of the indicated torque of the engine when the engine temperature signal is less than the first predetermined temperature and greater than the second predetermined temperature.

9. The lubrication torque limit module of claim 1, wherein the first limit module:

generates the first torque limit signal to disable lubrication torque limiting of the indicated torque of the engine when the speed of the engine is less than a predetermined speed; and generates the first torque limit signal to enable lubrication torque limiting of the indicated torque of the engine when the speed of the engine is greater than the predetermined speed.

10. The lubrication torque limit module of claim 1, wherein the second limit module sets the limit period based on at least one of (i) an amount of time for a fluid to be received by an engine system device, and (ii) an amount of time for a pressure of the fluid in the engine system device to be greater than a predetermined pressure.

11. The lubrication torque limit module of claim 10, wherein:

the engine system device is a turbocharger; and the fluid is engine oil or engine coolant.

12. A system comprising:

a temperature module that determines a temperature of an engine and generates an engine temperature signal;

a first limit module that generates a first torque limit signal based on the engine temperature signal and a speed of the engine, wherein the first torque limit signal identifies an indicated torque maximum limit;

a second limit module that determines a limit period based on an amount of time the engine is OFF;

a torque arbitration module that limits indicated torque of the engine for the limit period and based on the indicated torque maximum limit, wherein the indicated torque of the engine is equal to an unmanaged brake torque of the engine plus an overall friction torque of the engine;

a propulsion torque arbitration module that receives torque requests including a driver torque request and the first torque limit signal and arbitrates the torque requests to generate a propulsion torque output signal; and an actuation module that adjusts at least one of spark timing, fuel supplied to the engine, and throttle position based on the propulsion torque output signal.

13. The system of claim 12, further comprising:

a transition module that generates a second torque limit signal based on the first torque limit signal and a limit period signal; and a maximum torque arbitration module that receives maximum torque limit requests including the second torque limit signal and arbitrates the maximum torque limit requests to generate an arbitrated limit output request, wherein the torque arbitration module limits the indicated torque of the engine based on the arbitrated limit output request.

14. A method comprising:

determining a temperature of an engine and generating an engine temperature signal;

generating a first torque limit signal based on the temperature signal and a speed of the engine, wherein the first torque limit signal identifies an indicated torque level;

determining a limit period based on an amount of time the engine is OFF; and limiting indicated torque of the engine for the limit period and based on the indicated torque level, wherein the indicated torque of the engine is equal to an unmanaged brake torque of the engine plus an overall friction torque of the engine.

15. The method of claim 14, further comprising:

receiving an oil temperature signal indicating an oil temperature of the engine;

receiving a coolant temperature signal indicating a coolant temperature of the engine;

selecting at least one of the oil temperature signal and the coolant temperature signal based on reception of the at least one of an engine oil and an engine coolant by a turbocharger; and generating the engine temperature signal based on the at least one of the oil temperature signal and the coolant temperature signal.

16. The method of claim 14, further comprising:

generating the first torque limit signal based on a catalyst light off signal; and generating the first torque limit signal based on a compressor pressure ratio.

17. The method of claim 14, further comprising:

generating a limit period signal based on the OFF time of the engine and the engine temperature signal, wherein the limit period signal indicates the limit period;

limiting the indicated torque of the engine based on the limit period signal;

generating the first torque limit signal based on a first table relating indicated torque to temperature of the engine and speed of the engine; and generating the limit period signal based on a second table relating an indicated torque limit period to the amount of time the engine is OFF and the engine temperature signal.

18. The method of claim 14, further comprising:

generating the first torque limit signal to disable lubrication torque limiting of the indicate torque of the engine when the engine temperature signal is greater than a first predetermined temperature and less than a second predetermined temperature, the second predetermined temperature is greater than the first predetermined temperature; and generating the first torque limit signal to enable lubrication torque limiting of the indicated torque of the engine when the engine temperature signal is less than the first predetermined temperature and greater than the second predetermined temperature.

19. The method of claim 14, further comprising:

generating the first torque limit signal to disable lubrication torque limiting of the indicated torque of the engine when the speed of the engine is less than a predetermined speed; and generating the first torque limit signal to enable lubrication torque limiting of the indicated torque of the engine when the speed of the engine is greater than the predetermined speed.

20. The method of claim 14, further comprising:

generating a second torque limit signal based on the first torque limit signal and a limit period signal;

a maximum torque arbitration module that receives maximum torque limit requests including the second torque limit signal and arbitrates the maximum torque limit requests to generate an arbitrated limit output request;

receiving torque requests including a driver torque request and the arbitrated limit output request;

arbitrating the torque requests to generate a propulsion torque output signal; and adjusting at least one of spark timing, fuel supplied to the engine, and throttle position based on the propulsion torque output signal.

* * * * *